US005802655A

United States Patent [19]

Denton

[11] Patent Number: 5,802,655

[45] Date of Patent: Sep. 8, 1998

[54] CLEANER-WIPER PACKAGE

[76] Inventor: Thomas W. Denton, 780 Waldon Rd., Orion Township, Oakland County, Mich. 48359

[21] Appl. No.: 683,134

[22] Filed: Jul. 18, 1996

[51] Int. Cl.[6] ..... A47K 7/03

[52] U.S. Cl. ..... 15/104.93; 15/209.1; 15/220.1; 206/494; 206/812

[58] Field of Search ..... 15/104.93, 104.94, 15/208, 209.1, 210.1, 214, 220.1; 206/207, 209, 494, 812; 401/139

[56] References Cited

U.S. PATENT DOCUMENTS

| | | | |
|---|---|---|---|
| 1,702,172 | 2/1929 | Rennie | 15/210.1 |
| 2,076,604 | 4/1937 | Watson | 15/104.93 |
| 2,102,858 | 12/1937 | Schlumbohm | 15/104.93 |
| 2,875,461 | 3/1959 | Anderson . | |
| 3,169,264 | 2/1965 | Walker . | |
| 5,031,264 | 7/1991 | Muster | 15/104.93 |
| 5,046,608 | 9/1991 | Laiply | 206/812 |
| 5,058,738 | 10/1991 | Svensson | 206/209 |
| 5,111,934 | 5/1992 | Morin | 15/104.94 |
| 5,242,057 | 9/1993 | Cook et al. | 206/494 |
| 5,408,718 | 4/1995 | Sadovsky . | |

*Primary Examiner*—Terrence Till
*Attorney, Agent, or Firm*—Charles W. Chandler

[57] ABSTRACT

A kit containing a washing cleaner liquid and one or more paper towels can be used for cleaning an automotive windshield in situations where cleaning materials may not be readily available. The cleaning liquid is contained within a sealed pocket structure that includes a porous wall. Hand movement of the kit package across the windshield, or other surface to be cleaned, causes the liquid cleaner to flow through the porous wall and distributed over the work surface. The paper towel can be removed from the kit package for removing the emulsified dirt and wiping the surface to a clean dry condition.

12 Claims, 3 Drawing Sheets

CLEANER-WIPER PACKAGE

BACKGROUND OF THE INVENTION

Invention relates to a package or kit containing a cleaner liquid and at least one folded towel. The package is especially useful for cleaning automotive windshields, i.e. by applying the cleaner liquid to the windshield to emulsify dirt particles, and wiping the windshield with the towel to remove the liquid-dirt emulsion.

PRIOR ART DEVELOPMENTS

Various types of pads, wash cloths and mitts have been developed for hand-cleaning objects and surfaces.

U.S. Pat. No. 2,875,461, issued to P. G. Anderson, discloses a windshield cleaning device in the form of a cleaning mitt. One wall of the mitt is formed out of a toweling material. The other wall of the mitt is formed out of a soft chamois material. The user dips the mitt into a washing (soap) solution and rubs the towel surface on an automobile windshield to loosen the dirt. He then reverses the mitt on his hand, and rubs the chamois surface on the windshield to remove the water and dirt.

U.S. Pat. No. 3,169,264 issued to W. L. Walker, discloses a double layer wash cloth, wherein one face of the cloth is abrasive, and the other face is soft and absorbent. The abrasive surface is used to loosen the dirt from the dirty surface. The soft absorbent surface is used to remove the dirt-water emulsion.

U.S. Pat. No. 5,408,718 granted to Shmuel Sadovsky, discloses a cleaning pad that includes a sponge core and an outer covering having an abrasive area and a non-abrasive area. The pad is designed specifically for use on dishes, silverware and cooking pots.

SUMMARY OF THE INVENTION

The present invention relates to a cleaning and drying device having special utility on automotive windshields. The device preferably is in the form of a package containing windshield washer fluid and a folded paper towel. The package can be kept in the glove compartment of the person's automobile for use on the road when the windshield has become coated with dirt or other contaminants that would pose a visibility problem.

When it becomes necessary to clean the windshield and there is no water or cleaning solution readily available, the cleaning package can be removed from the automobile glove box and used as a cleaning implement. The package comprises a sealed pocket structure containing windshield washer fluid or other cleaning solution. The package can be used as a soap pad to apply the cleaning solution to the windshield surface, thereby emulsifying the dirt and contaminants in the solution. The folded paper towel, contained in the package, can be unfolded and wiped over the windshield surface to remove the dirt and liquid.

The cleaning package of this invention is designed especially for situations where there is no water or cleaning liquid readily available, e.g. when a motorist is out on the road in a remote location away from a gasoline service station or city water supply. The cleaning package has a self-contained supply of cleaning solution, as well as a porous pad surface for applying the cleaning solution to an automotive windshield, and a compactly folded towel that can be unfolded for wiping the windshield to an essentially dry, dirt-free condition.

In the preferred practice of the invention, the cleaning package has a relatively small overall dimension, measuring about three inches wide, three inches long, and one inch thick. The package can be enclosed in an aluminum foil envelope for compact leak-free storage in the vehicle glove box.

Specific features and advantages of the invention will be apparent from the attached drawings and descriptions of an illustrative embodiment of the invention.

DESCRIPTION OF THE DRAWINGS

The description refers to the accompanying drawings in which like reference characters refer to like parts throughout the several views, and in which:

FIG. 4 shows a protective covering for the towels; the covering is omitted from FIG. 3 for illustration purposes;

DESCRIPTION OF A PREFERRED EMBODIMENT OF THE INVENTION

Figure 4:
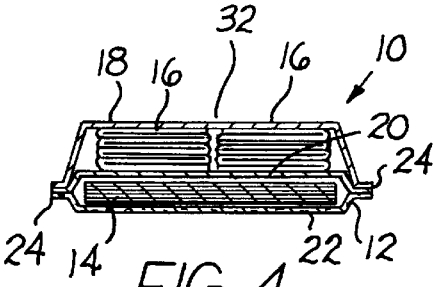
FIG. 4 is a view taken in the same direction as FIG. 3, but with both towels in folded conditions. Also.

FIG. 4 shows a combination cleaner-wiper package 10 constructed according to the invention. The package comprises a sealed pocket structure 12 containing a cleaner liquid source 14, and two folded towels 16 positioned on the upper external face of the pocket structure. A protective covering 18 is provided over the folded towels.

Figure 5:
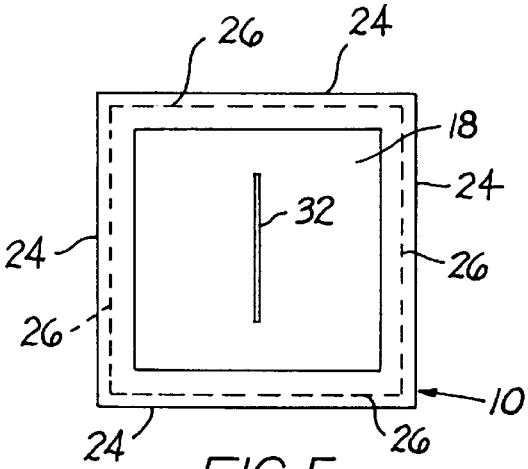
FIG. 5 is a plan view of the package depicted in FIG. 4.

Pocket structure 12 comprises an imperforate upper wall 20 and a porous perforate lower wall 22. Peripheral edge areas 24 of walls 20 and 22 are sealed together, preferably by stitching 26 (FIG. 5). The stitching process is preferably carried out after the protective covering 18 has been applied to the folded towels 16, such that the stitching holds the entire package 10 together. Alternatively, the pocket structure walls 20 and 22 can be stitched together in one operation, and the protective covering 18 attached to the pocket structure as a separate operation.

Upper wall 20 of pocket structure 12 can be formed of a relatively thick sheet of cellophane or flexible plastic. The principal requirement is that wall 20 be imperforate so as to isolate the folded towels 16 from the liquid cleaner source 14 in the pocket structure. Lower wall 22 of the pocket structure can be formed of a porous fibrous felt material, whereby the liquid cleaner can pass through the pores in the felt material for application to the work surface that is to be cleaned.

The invention has, as a major application, the cleaning of automotive windshields. The cleaning liquid 14 can in this case be window washer fluid. The user applies the washer fluid to the windshield surface by holding the package in one hand, and moving the package over the windshield surface so that liquid passes through the porous felt wall 22 directly onto the windshield surface.

The cleaning liquid is preferably contained within one or more absorbent paper sheets (or layers) located within pocket structure 12, such that each sheet is in a saturated condition. When the package is at normal atmospheric pressure the porous felt material wall 22 offers sufficient liquid flow resistance that the cleaner solution is contained within the pocket structure. However, when the person exerts hand pressure on package 10, the cleaner solution is pressurized sufficiently to flow through porous wall 22 onto the surface to be cleaned, e.g. the surface of a windshield.

Figure 8:
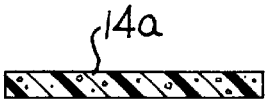
FIG. 8 is a sectional view taken through a liquid-saturated sponge that can be used in the FIG. 4 package to provide a liquid cleaner source.
Figure 9:
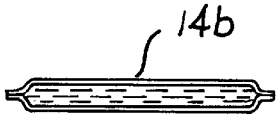
FIG. 9 is a sectional view taken through a liquid-filled capsule that can be used in the FIG. 4 package to provide an alternative liquid cleaner source.

FIGS. 8 and 9 show alternative forms that the cleaning liquid source can take. As shown in FIG. 8, the liquid cleaner source comprises a porous sponge pad 14*a* saturated with the cleaning solution. As shown in FIG. 9, the liquid cleaner source comprises a thin flat capsule 14*b* filled with the liquid cleaner. The walls of the sealed capsule 14*b* are relatively fragile, so that when the user applies a squeezing pressure onto package 10, at least one of the capsule walls breaks to release the cleaner liquid.

The liquid cleaner source 14 or 14*a* or 14*b* preferably occupies essentially the entire interior space within the pocket structure. Typically the cleaner source can have a dimension measuring about two and one half inches long, two and one half inches wide and one quarter inch thick. Package 10 can have an outside dimension measuring about three inches long, three inches wide, and one inch thick.

As shown in FIG. 4, package 10 contains two folded towels 16 located on the upper face of pocket structure 12. Each towel is folded into a rectangular configuration having multiple superimposed folds or layers, whereby each towel occupies about one half the available space on wall 20. The towels are preferably formed of absorbent paper, such that when the towel is unfolded it can be wiped over the work surface containing the emulsified dirt to absorb the emulsifying cleaner liquid. This produces an essentially clean dry work surface free of streaks or dirt particles. The towels are intended for use especially on automotive windshields.

Figure 1:
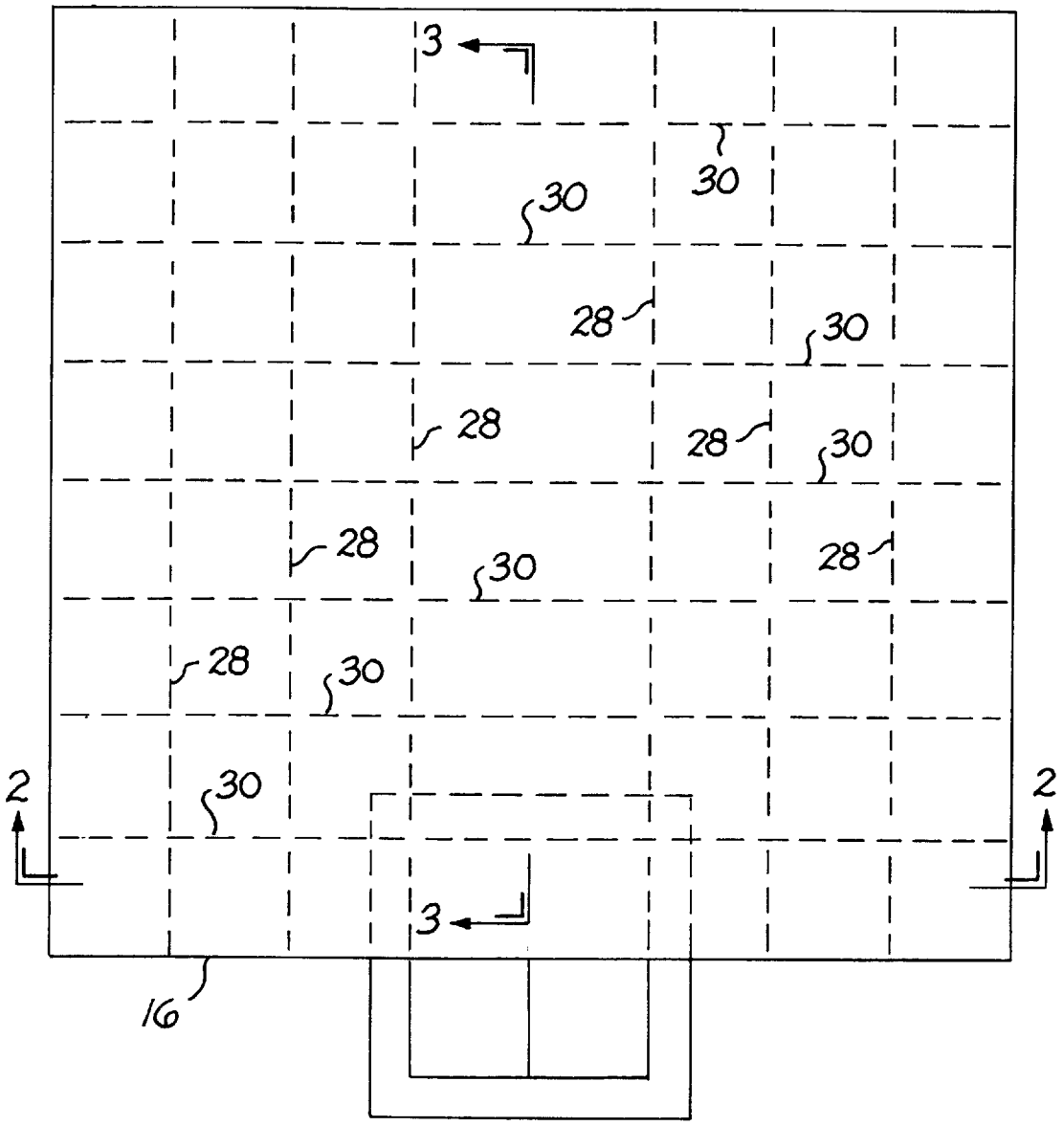
FIG. 1 is a plan view of a cleaner package embodying the invention. A towel, embodied in the package, is shown in an unfolded condition.
Figure 2:
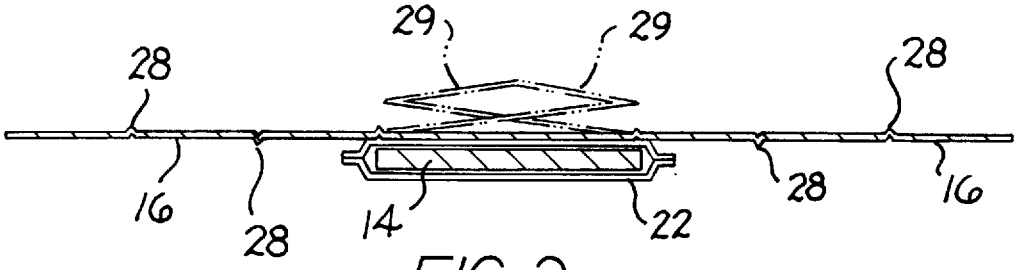
FIG. 2 is a section view taken on line 2—2 in FIG. 1.
Figure 3:
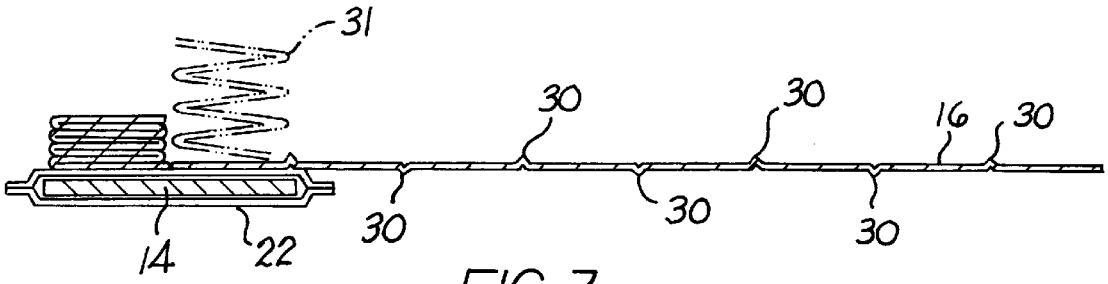
FIG. 3 is a transverse section view taken on line 3—3 in FIG. 1.

FIGS. 1, 2, and 3 illustrate one method or pattern of folding a representative towel. FIG. 1 shows one of the towels completely unfolded to its usage position. FIG. 2 shows, in dashed lines, the towel in a partially folded condition. FIG. 3 shows, in dashed lines, the towel in its fully folded condition.

Referring to FIG. 1, paper towel 16 has a first plurality of score lines (or perforations) 28 running in the vertical direction, and a second plurality of score lines 30 running in the horizontal direction (i.e. normal to fold lines 28). As shown in FIG. 2 (dashed lines), the sheet can be folded around fold line 28 to form two sets of accordion like walls.

Referring to FIG. 3, the partially folded sheet of FIG. 2 can be folded a second time along fold lines 30 to form a multi-layer sheet construction 31 occupying approximately one half the available space on wall 20. The other towel in the package occupies the remaining space above wall 20. Both towels are preferably folded in the same pattern, or fashion.

The folded towels 16 are held in place by protective covering 18. Covering 18 is preferably a thin sheet of cellophane having its peripheral edges attached to edge areas of pocket structure 12, e.g. by stitching 26 or by suitable adhesive. The protective covering 18 may be provided with a central slit 32 to facilitate the process of opening the covering to gain access to one or both towels 16. Alternatively, a series of perforations can be formed in a slit-like pattern in covering 18.

Preferably each towel 16 has the towel area in contact with wall 20 adhesively attached to the wall, such that when the exposed edge of the respective towel is pulled out of the package the towel will readily unfold to the FIG. 1 condition. The unfolding action is facilitated by having a facial area of the towel attached to wall 20. When the towel is fully unfolded it can be torn away from the package if the user so desires.

Figure 7:
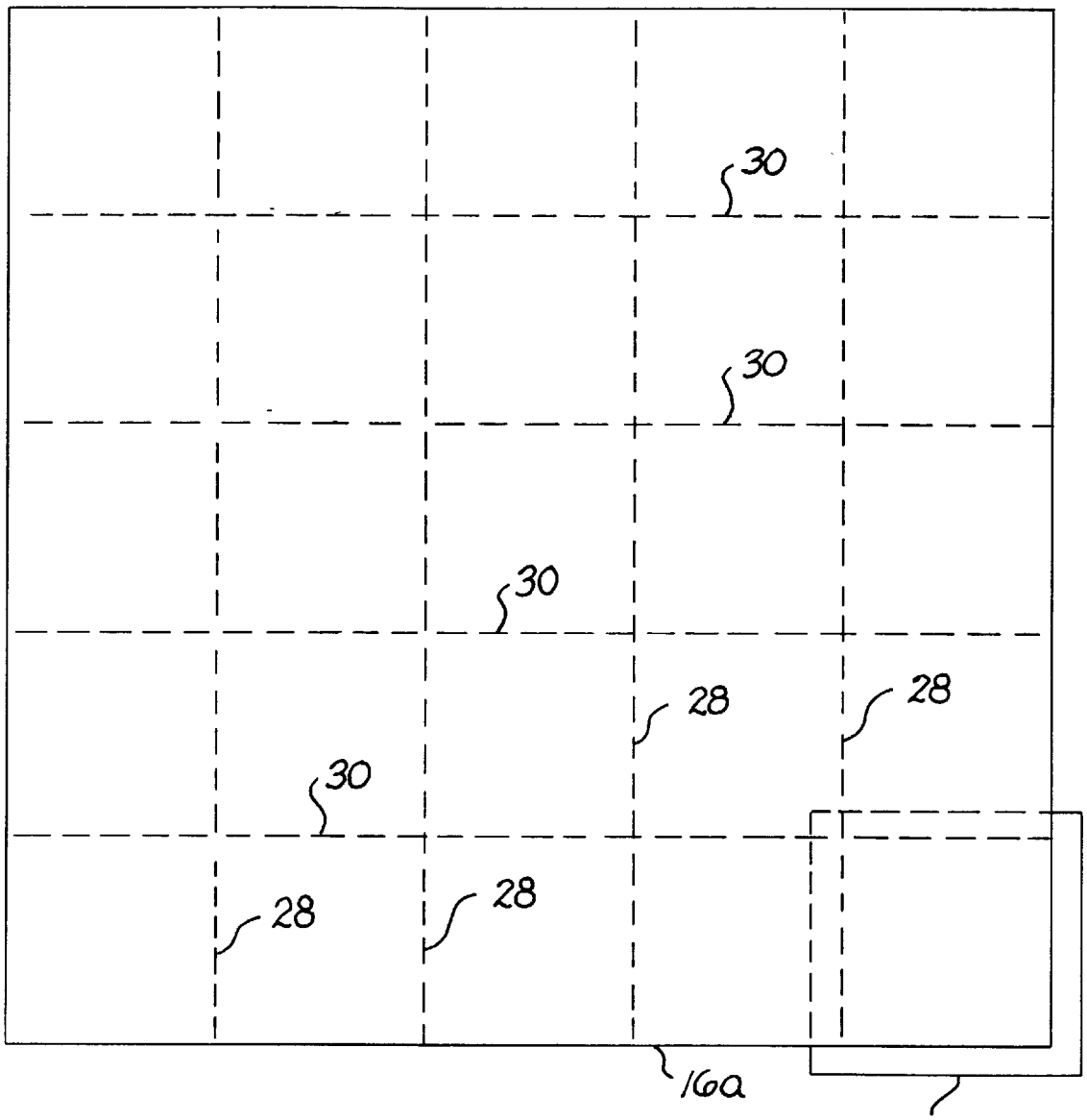
FIG. 7 is a view taken in the same direction as FIG. 1, but illustrating an alternative arrangement embodying the invention.

FIGS. 1 shows an arrangement wherein two towels 16 are provided in the cleaner-wiper package. FIG. 7 shows an alternative arrangement, wherein the package contains a single paper towel 16*a*. The towel is folded in the same fashion as the previously described towel 16. Towel 16*a* can be somewhat larger than either individual towel 16, since it occupies the entire available space on wall 20. The package depicted in FIG. 7 is similar to the previously described package, except that it contains only one paper towel instead of two towels.

Figure 10:
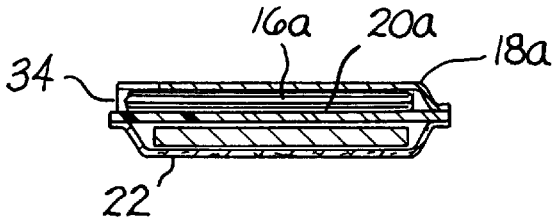
FIG. 10 is a sectional view taken in the same direction as FIG. 4, but showing an alternative package construction embodying the invention.

FIG. 10 shows a further form that the invention can take. In this case the sealed pocket structure comprises a relatively rigid flat upper wall 20*a*, preferably formed out of a plastic sheet. The lower wall 22 of the pocket structure is the same felt material, as previously described.

The single folded paper towel 16*a* is located on the upper surface of wall 20*a* so as to be partially surrounded by a protective covering 18*a*. Covering 18*a* is attached to wall 20*a* around three of its edges, leaving the fourth edge of the covering unconnected. The unconnected edge of covering 18*a* forms an access opening 34 that enables the person to grip the exposed edge of the folded paper towel 16*a*. The paper towel can be withdrawn and unfolded for use, essentially as previously described. Towel 16*a* is a separate sheet not attached to wall 20*a* or covering 18*a*.

FIGS. 1 through 5 represent the preferred form of the invention. FIGS. 7 through 10 illustrate less preferred variants that can be used in the practice of the invention.

Figure 6:
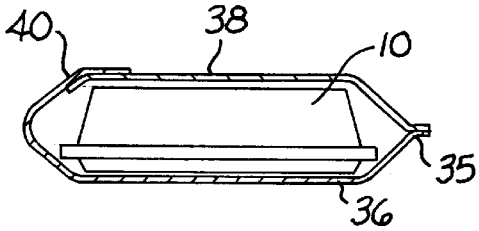
FIG. 6 shows the FIG. 4 package enclosed within an aluminum foil pouch for storage purposes, e.g. in the glove box of an automotive vehicle.

Any one of the described packages 10 can be stored within an aluminum foil pouch, as shown at 35 in FIG. 6. The pouch preserves the package in a clean condition, while confining any leakage of the cleaner solution to the pouch interior space.

As shown in FIG. 6, the pouch is formed of a lower sheet of aluminum foil 36 and an upper sheet of aluminum foil 38. The two sheets of foil are connected together around three of the four peripheral edges, leaving the fourth set of edges unconnected. Lower foil sheet 36 has an extension 40 that forms a flap adapted for disposition on the upper face of sheet 38, as shown in FIG. 6.

Aluminum foil material is flexible, while at the same time being non-resilient. The material is used for pouch 35 because it can be easily closed and maintained in a sealed condition, i.e. by drawing flap 40 onto wall 38.

The drawings show various forms and configurations that the invention can take. However, it will be appreciated that the invention can be practiced in various arrangements and constructions.

I claim:

1. A cleaner-wiper package comprising:

a pocket structure that includes an imperforate wall and a perforate wall;

a cleaner liquid contained within said pocket structure for passage through said perforate wall onto a work surface when the pocket structure is pressed against said surface;

at least one towel located on said imperforate wall, whereby said towel can be unfolded to wipe cleaner liquid and entrained dirt off of the work surface; and means for attaching a facial edge area of the folding towel to said imperforate wall.

2. The cleaner wiper package of claim 1, wherein said imperforate wall and said perforate wall have mating peripheral edges connected together.

3. The cleaner-wiper package of claim 2, and further comprising stitch means for connecting the mating peripheral edges of the imperforate wall and perforate wall.

4. The cleaner-wiper package of claim 2, wherein the imperforate wall is cellophane, and said perforate wall is a porous felt material.

5. The cleaner-wiper package of claim 4, and further comprising a protective covering secured to said imperforate wall for containment of the folded towel.

6. The cleaner-wiper package of claim 5, wherein said protective covering is cellophane.

7. The cleaner-wiper package of claim 1, wherein said folded towel is formed of moisture-absorbent paper.

8. The cleaner-wiper package of claim 1, and further comprising multiple layers of liquid-absorbent paper located in said pocket structure;

said cleaner liquid being absorbed into the multiple paper layers, whereby said paper layers are saturated with the cleaner liquid.

9. The cleaner-wiper package of claim 1, wherein said cleaner liquid is window washer fluid, whereby the package is adapted for use on automotive windshields.

10. The cleaner-wiper package of claim 1, and further comprising an openable pouch formed of aluminum foil for enclosing the cleaner-wiper package.

11. The cleaner-wiper package of claim 1, wherein there are two folded towels on said imperforate wall.

12. The cleaner wiper package of claim 1, wherein said folded towel has a first plurality of parallel folds in a first direction, and a second plurality of folds in a second direction orthogonal to said first direction.

* * * * *